US005976692A

United States Patent [19]

Brezler, III et al.

[11] Patent Number: 5,976,692

[45] Date of Patent: Nov. 2, 1999

[54] NATURAL BRISTLE REPLACEMENT FOR COSMETIC AND OTHER BRUSHES

[75] Inventors: Russel A. Brezler, III, Mineral Wells; Robert L. Rackley, deceased, late of Parkersburg, both of W. Va., by Mary Ann Rackley, executrix

[73] Assignee: E. I. du Pont de Nemours and Company, Wilmington, Del.

[21] Appl. No.: 08/976,431

[22] Filed: Nov. 21, 1997

[51] Int. Cl.[6] ..... D02G 3/00

[52] U.S. Cl. ..... 428/372

[58] Field of Search ..... 428/372

[56] References Cited

U.S. PATENT DOCUMENTS

| | | | |
|---|---|---|---|
| 3,325,845 | 6/1967 | Sawkiw . | |
| 3,651,014 | 3/1972 | Witsiepe . | |
| 3,763,109 | 10/1973 | Witsiepe . | |
| 3,766,146 | 10/1973 | Witsiepe . | |
| 4,112,040 | 9/1978 | Orentreich . | |
| 4,157,275 | 6/1979 | Hollander | 428/372 |
| 4,225,649 | 9/1980 | Peterson | 428/372 |
| 4,258,093 | 3/1981 | Benedyk | 428/287 |
| 4,343,859 | 8/1982 | Lundberg et al. | 428/372 |
| 4,515,858 | 5/1985 | Bayan . | |
| 4,610,925 | 9/1986 | Bond . | |
| 4,912,148 | 3/1990 | Kim et al. | 524/487 |
| 5,165,760 | 11/1992 | Gueret . | |
| 5,195,546 | 3/1993 | Cansler . | |
| 5,238,011 | 8/1993 | Gueret . | |

*Primary Examiner*—Newton Edwards
*Attorney, Agent, or Firm*—Inna Y. Belopolsky

[57] ABSTRACT

Synthetic monofilaments or bristles made from a thermoplastic elastomeric composition containing an aluminum silicate. The synthetic monofilaments or bristles possess properties, such as stiffness, similar to those of natural bristles such as goat hair, but without the unwanted side effects of natural bristles or prior synthetic bristles. A method for making such synthetic monofilaments or bristles of various lengths and diameters having a desirable wavy appearance is achieved by post-conditioning or mechanically crimping the monofilaments. The synthetic monofilaments or bristles are capable of being formed into brushes of all types and for all uses, especially as cosmetic brushes.

8 Claims, 4 Drawing Sheets

NATURAL BRISTLE REPLACEMENT FOR COSMETIC AND OTHER BRUSHES

FIELD OF THE INVENTION

The present invention relates generally to synthetic bristles, and more particularly, to a method of forming synthetic bristles having a softness, texture and non-uniform wavy appearance to emulate and replace natural bristles in cosmetic and other brushes.

BACKGROUND OF THE INVENTION

The superiority of natural bristles over presently available synthetic bristles in cosmetic and other types of brushes has long been recognized. In particular, cosmetic brushes have traditionally been made either with (1) natural bristles such as goat's hair bristles or (2) synthetic filaments made, for example, from polyamides (such as nylon) and polyesters. Natural bristles have traditionally been used more extensively than synthetic bristles in such brushes.

The use of the natural bristles, however, has several significant drawbacks. Inconsistent supplies of natural bristles and unacceptable variations from one batch of bristles to another often impede manufacture of brushes having natural bristles. In addition, natural bristles must be treated for hygienic purposes to eliminate the presence of contaminants, such as lice and lice eggs. Even if properly treated, many individuals are nevertheless allergic to natural bristles.

In view of these problems associated with the use of natural bristles, various attempts have been made to replace natural bristles with synthetic materials. The use of synthetic bristles has also met with difficulties, however. Synthetic bristles tend to be much stiffer than natural bristles. In addition, synthetic bristles simply do not have the softness, texture and overall appearance of natural bristles. For example, even though attempts have been made to replicate the wavy appearance of a natural bristle, most such attempts have provided only an artificial symmetrical wavy appearance in synthetic bristles. As such, these attempts have served to exacerbate the unnatural look and feel of synthetic bristles.

In addition, use of some synthetic bristle brushes (especially those for applying mascara) has been found to cause irritation to sensitive eyes as the brushes were not made from bristles of a small enough diameter. Use of small-diameter bristles in cosmetic brushes has also been found to be unacceptable as the bristles pick up too little product and simply "dump" cosmetic product onto the skin.

For these reasons, it is highly desirable to develop a type of bristle that can be used in cosmetic and other brushes which feels like natural bristles to the skin, and is free from natural contaminants to eliminate the need for sterilization prior to manufacture.

SUMMARY OF THE INVENTION

The present invention is directed to synthetic monofilaments or bristles, as well as novel methods and polymeric compositions used to manufacture them, where the synthetic monofilaments serve to remedy the above-cited problems with both natural and existing synthetic bristles. The bristles of the present invention are formed from a type of thermoplastic elastomer that permits the production and manufacture of small diameter bristles free from natural contaminants and other irritants, and yet exhibit the desirable texture and feel of natural bristles. As such, the bristles of the present invention are an effective and convenient replacement for natural bristles in cosmetic brushes and other types of brushes.

As such, the present invention includes a brush having a plurality of synthetic monofilaments, each of the plurality of synthetic monofilaments being formed from a composition comprising a thermoplastic elastomer and an aluminum silicate.

The present invention also includes a method for producing a synthetic monofilament having a stiffness equal to or less than that a goat hair bristle with a diameter equal to the synthetic monofilament, the method including the steps of: (a) extruding, quenching, drawing and relaxing a monofilament of a thermoplastic elastomer containing an aluminum silicate; (b) applying a finish to the monofilament; (c) wrapping the wet monofilament in hank paper; and (d) heating the monofilament while wrapped in the hank paper to a temperature of at least about 100° F. (38° C.) for at least about 4 hours.

The present invention also includes a method for producing a synthetic monofilament, including extruding, quenching, drawing and relaxing a monofilament rope of a thermoplastic elastomer containing an aluminum silicate; and mechanically crimping the monofilament rope.

DETAILED DESCRIPTION OF THE INVENTION

Figure 1:
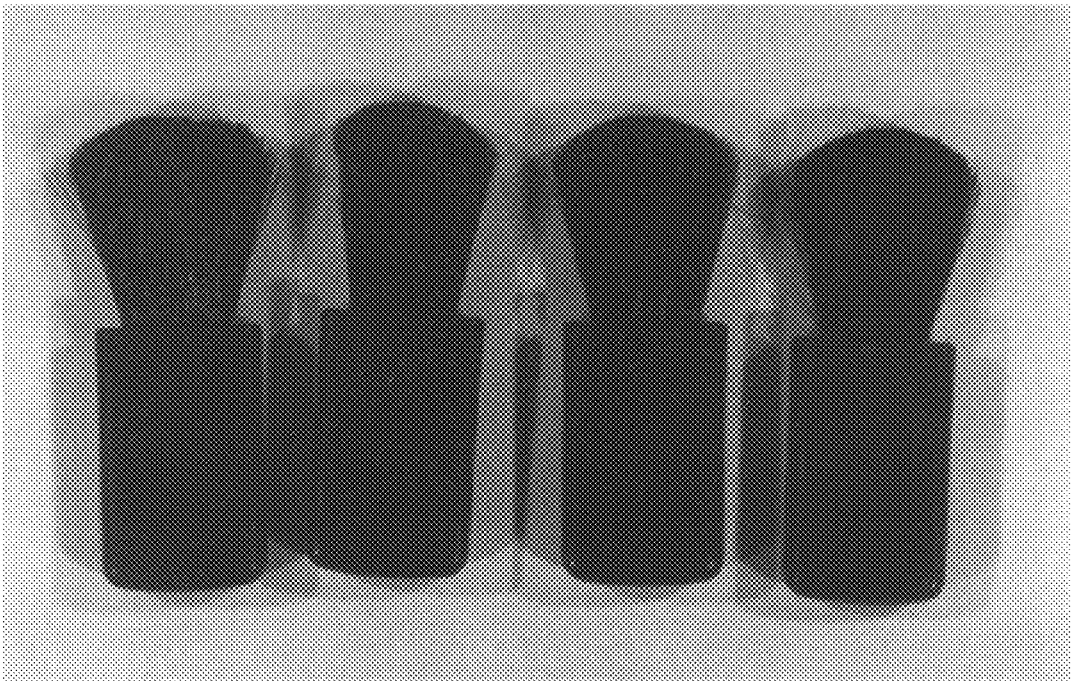
FIG. 1 is a photograph depicting (from left to right) brushes containing (a) conditioned synthetic bristles, (b) unconditioned and uncrimped bristles, and (c) crimped bristles in accordance with the present invention, as well as (d) goat hair bristles.

The present invention is directed to synthetic monofilaments having a softness, texture and non-uniform wavy appearance for replacement of natural bristles and currently-available synthetic bristles.

The synthetic monofilaments or bristles of the present invention are formed from a polymeric material, most advantageously from a thermoplastic elastomeric polymer (TPE). It is to be understood that the term "thermoplastic" includes all polymers that soften when heated, whether amorphous or crystalline, and the term "elastomer" includes all elastomers, whether linear chains or cross-linked. Such polymers may or may not contain a plasticizer. It is to be understood that a variety of thermoplastic elastomeric polymers may be used in the present invention. One such thermoplastic elastomer is HYTREL® 7246 polyester elastomer (supplied by E.I. du Pont de Nemours & Company). TPEs of this type are covered under U.S. Pat. Nos. 3,651,014, 3,763,109, and 3,766,146, whose disclosures are specifically incorporated herein by reference.

When used in the formation of the synthetic monofilaments or bristles according to the present invention, such thermoplastic elastomers are found in proportions of at least about 80% by weight, and advantageously in proportions in the range of about 85% to about 96% by weight, especially advantageously in proportions in the range of about 88% to about 93% by weight, and most advantageously in a proportion of about 87% by weight. When such proportions of the thermoplastic elastomer are present, any remaining proportions are made up of additional materials, including, but not limited to, aluminum silicates and coloring agents.

The aluminum silicate used in the present invention is typically present in a proportion in the range of about 2% to about 5% by weight and most advantageously in a proportion of about 3% by weight. It is to be understood that the present invention is not to be limited in any way to the specific form of the aluminum silicate used in the composition forming the synthetic monofilaments or bristles. Rather, other commercially available aluminum silicate preparation can be effectively used in forming the synthetic monofilaments or bristles of the present invention. For example, Hydrite™ UF clay, available from Dry Branch Kaolin Company in Georgia, has been found to work well in producing the composition used in forming the synthetic monofilaments or bristles of the present invention.

It should also be understood that when proportions of silicate outside of the ranges recited herein are used, the resulting synthetic monofilaments or bristles may not have the highly desirable properties recited herein for the synthetic monofilaments or bristles according to the present invention. For example, if proportions of silicate much above the about 5% upper limit of the ranges recited herein are used, the resulting synthetic monofilaments or bristles may be produced in lower yields and exhibit an increased tendency toward breakage. Conversely, where the lower limit of about 2% is crossed, the resulting synthetic monofilaments or bristles will fail to show the highly desirable dulling quality (thus tending to give any subsequent colored filaments an excessively, or at least unwanted, shiny appearance) and will also fail to exhibit the characteristic feel and texture found desirable for bristles intended for the applications recited herein.

The synthetic monofilaments or bristles of the present invention may also contain, in addition to the above-recited components, a colorizing agent or colorant. The purpose of such colorant is to lend color or shade to otherwise colorless bristles, thus making them more appealing to the eye. When such colorizing agents, or colorants, are present in the composition making up the synthetic monofilaments or bristles of the present invention, such colorants or colorizing agents are normally found in a proportion of between about 2% to about 10% by weight. It is to be understood that other useful agents may be added to the aforementioned thermoplastic elastomeric compositions. As such, it is to be understood that the compositions of the present invention are not to be limited to those components recited above.

With reference to FIG. 1, a photograph is shown which depicts various bristles made with the materials and methods of the present invention, as compared to a natural goat hair brush. As will be described in greater detail below, the bristles of the present invention may be either conditioned or crimped to provide the bristles with a non-uniform wavy appearance which emulates natural bristles. With continuing reference to FIG. 1, the photograph depicts from left to right, conditioned, unconditioned and crimped synthetic bristles made in accordance with the present invention, as well as a natural goat hair brush.

Methods for Producing the Synthetic Monofilaments

The method of the present invention for producing synthetic monofilaments or bristles from compositions including thermoplastic elastomers and aluminum silicates, and possibly colorants and other agents will now be described in greater detail.

The general method for producing the synthetic monofilaments according to the present invention comprises several steps. The first step includes extruding a monofilament formed of a thermoplastic elastomer (or TPE) composition containing an aluminum silicate (and possibly a colorant or other agents) in relative proportions covered by the ranges recited. For this purpose, any common polymer extrusion method for monofilaments can be employed and the particular extrusion procedure used in no way limits the method according to the present invention. Such extrusion process will also include the usual steps of extruding, quenching, drawing and relaxing the filament rope. The relaxing step includes a conditioning process including heating the monofilament from about 320° F. (165° C.) to about 347° F. (about 175° C.) for between 10 and about 20 seconds, and most advantageously at about 338° F. (about 170° C.) for about 20 seconds. Once these steps are completed, the monofilament may be either further post-conditioned or crimped to achieve a non-uniform wavy appearance. These post-conditioning and crimping processes will now be described in greater detail. Both procedures achieve a very natural looking wave in the filament rope and the final brush.

1. Monofilament Post-Conditioning

With reference to the flowchart of FIG. 2, the post-conditioning process of the present invention will now be described. After the monofilaments have been extruded in step 10 of FIG. 2, the extruded monofilaments are then post-conditioned so as to achieve the production of a monofilament having the stiffness, as well as the texture (or overall feel) and/or flexural modulus, and tensile strength typically exhibited by natural bristles. Synthetic monofilaments or bristles according to the present invention may also have a stiffness equivalent to or less than that of natural bristles, especially those used in the manufacture of brushes of all types. Flexural modulus and stiffness are defined by the polymer, the extrusion and drawing process, and the diameter of the filament. Flexural modulus and stiffness are not affected by the following post-conditioning process. The post-conditioning affects only the texture, feel and appearance of the filament.

Figure 2:
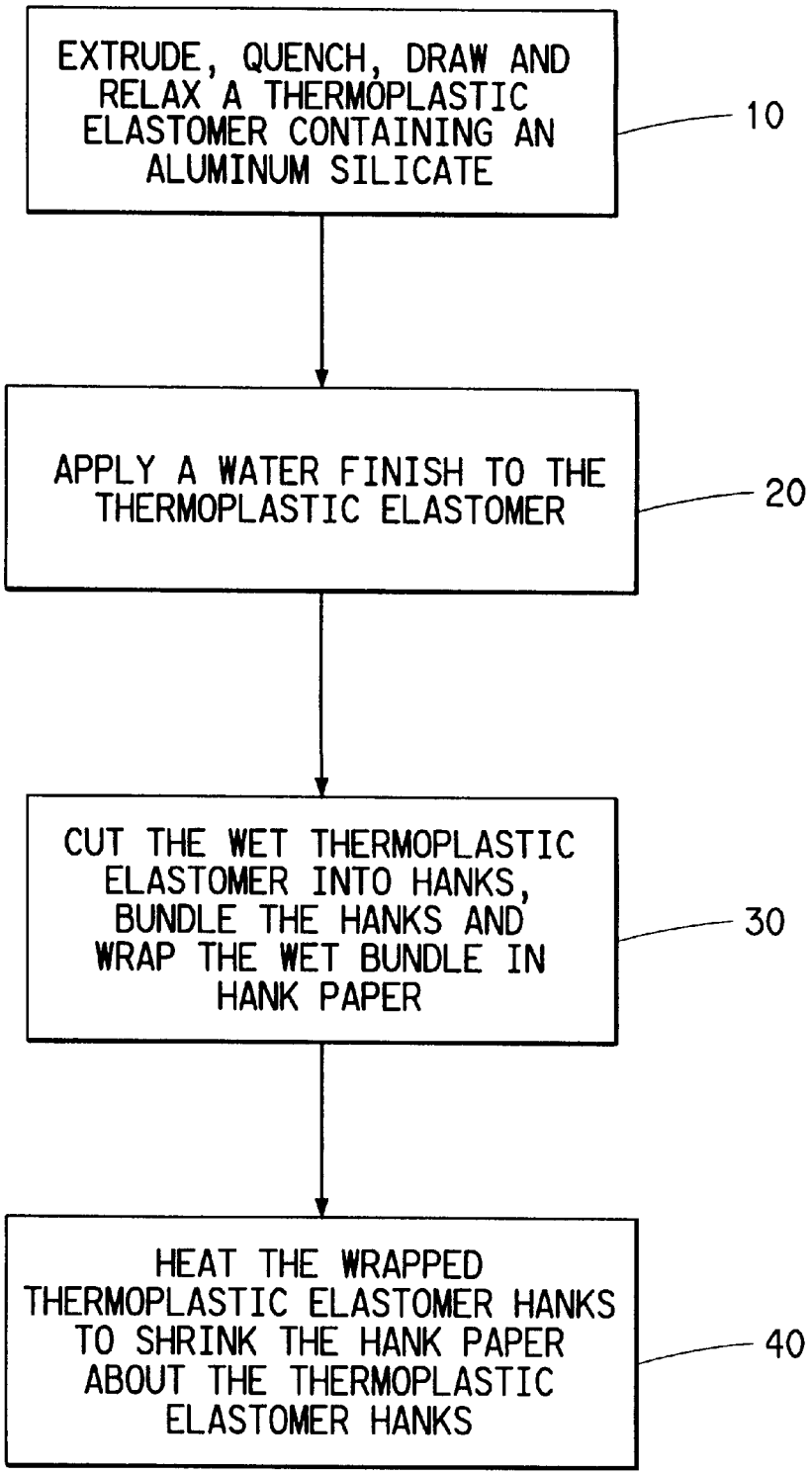
FIG. 2 depicts the crimping process of the present invention including a sketch of the gears used to create the characteristic wavy appearance of the synthetic monofilaments produced according to the invention.

With continuing reference to FIG. 2, the post-conditioning process of the present invention includes a first step 20 of applying a water finish to the monofilament. Various techniques may be used to apply this water finish, such as passing the monofilament through a water bath. The second step 30 of this post-conditioning process involves cutting the monofilament into discrete lengths (for example, 45 inches or 115 cm in length) of monofilament hanks, bundling the monofilaments (preferably into a cylindrical bundle) and wrapping the bundles in hank paper while the monofilament hanks are still wet from the application of the water finish. One type of hank paper which may be used is hank paper #IC189001 made by Cindus Corp., Cincinnati, Ohio, although it is to be understood that other types of hank paper may be used. The third step 40 of the post-conditioning process involves heating the wet monofilament hanks wrapped in hank paper. The extruded monofilaments are heated to temperatures in the range of about 100° F. (about 38° C.) or higher, and advantageously in the temperature range of about 100° F. (about 38° C.) to about 200° F. (about 93° C.), and most advantageously to a temperature of about 175° F. (about 79° C.). Such heating will normally be carried on for a period of at least about 4 hours, advantageously over a period of between about 4 hours and about 5 hours, and most advantageously for a period of about 4.5 hours.

During the post-conditioning process, the monofilament hanks and hank paper shrink in such a way that a non-uniform and subtle wave are produced in the monofilaments. Most significantly, it has been found that shrinkage of the hank paper about the monofilaments imparts this highly desirable subtle crimp to the monofilaments, as well as a unique texture that emulates natural bristles. In particular, while heating a bundle of monofilament hanks of about 45 inches (about 115 centimeters) in length and about 1.7 to 1.9 inches (about 43 mm to 47 mm) in diameter at a temperature of about 175° F. (about 80° C.) for about 4.5 hours, the hank paper was found to shrink about 0.5% and the thermoplastic elastomer was found to shrink about 2%.

As such, this procedure produces a natural wave or crimp that is non-uniform in amplitude and frequency along the length of each filament as well as from filament to filament. Such a wavy appearance will typically be characterized as being more random than other commonly used synthetic polymer bristles and will also be characterized as being non-repetitive in nature. Non-uniformity in waves between monofilament hanks is due to the fact that since the monofilament hanks are bundled (preferably in a cylindrical bundle), the shrinkage of the hank paper affects monofilament hanks on the periphery of the bundle differently than monofilament hanks in the center of the bundle. This lack of uniformity further enhances the natural look and feel of the synthetic bristles post-conditioned in accordance with the present invention.

2. Monofilament Crimping

The wavy appearance of the bristles of the present invention can also be achieved through another novel process. This can be done by addition of a mechanical crimping step in place of the aforementioned post-conditioning process. Thus, the process would be one of extruding, quenching, drawing, relaxing and then mechanically crimping the resulting monofilament rope. This method of introducing a wavy appearance is highly advantageous relative to the conditioning, or post-conditioning, process in that the mechanical crimping process is less time consuming and the extruded monofilaments are easier to process. The mechanical crimp is a very light, regular and repetitive crimp.

Figure 3:
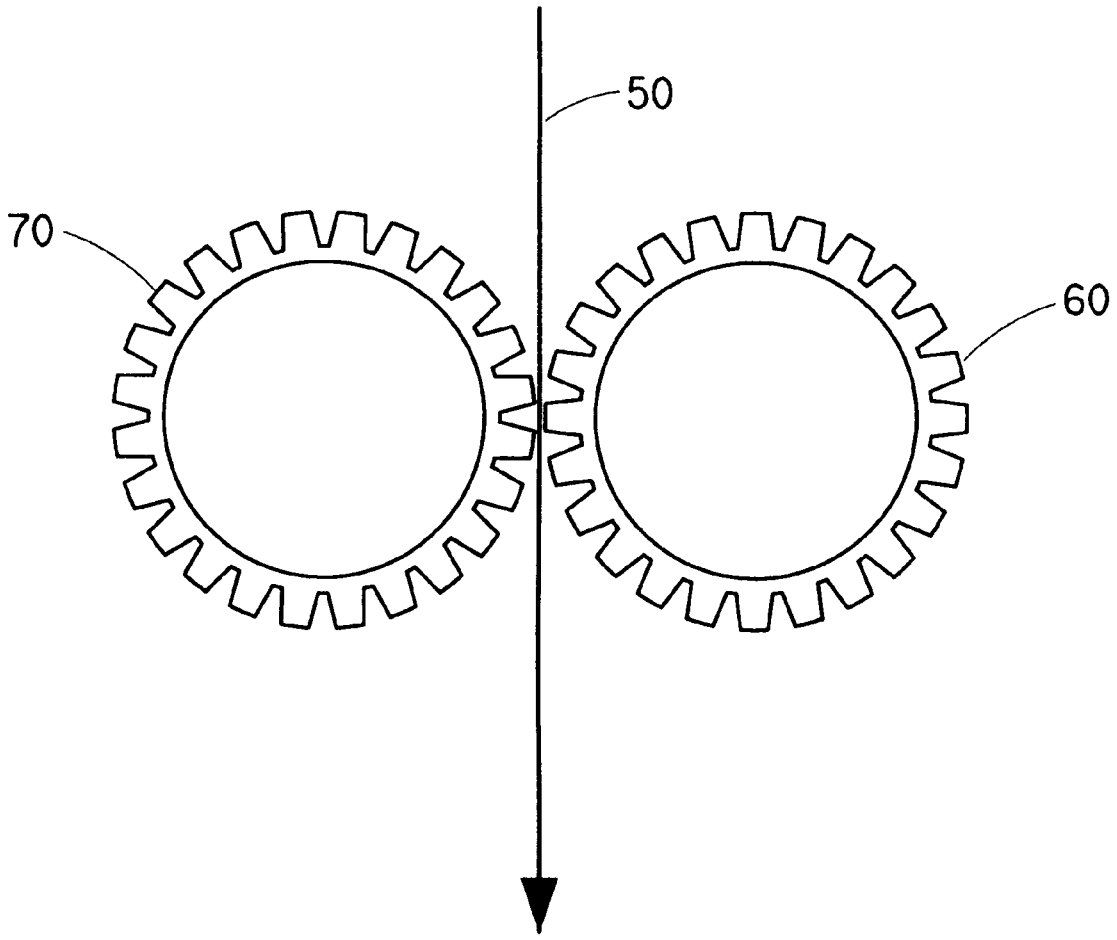
FIG. 3 is a flowchart depicting the synthetic monofilament conditioning process of the present invention.

With reference to FIG. 3, the crimp is produced by passing the filament rope 50 through at least 2 crimp gears 60,70, providing to such filaments 50 a crimp that is non-uniform from filament to filament. The crimp gears 60,70 produce a crimp with a period of 0.190 inches (4.83 mm) and a varying amplitude of 0 to 0.010 inches (0 to 0.254 mm). The amplitude is constant for each filament but, because of the way the filament rope passes through the crimp gears, the amplitude varies from one filament to another and thereby produces a very natural looking wave in the filament rope and the resulting brush. By way of example, crimp gears found to work well are circular in shape with a diametral pitch of 16 and a pitch diameter of 3.499. After crimping, a water finish is applied to the crimped monofilament rope.

It is noted that although post-conditioning and crimping achieve a natural-looking wave in the filament, one advantage of the crimping technique is the ability to maintain the monofilament in a continuous rope which may, for example, be wound upon a spindle for shipping. With post-conditioning, the monofilament must be cut into a plurality of monofilament hanks.

Characteristics of the Synthetic Monofilaments

In addition to having a typical wavy appearance, the synthetic monofilaments produced according to the present invention will also be characterized in having a relatively small diameter. Typically, monofilaments produced in accordance with the present invention will have a circular diameter, but also square, triangular, rectangular cross-sections can be used, and preferably in the range of between about 1 mil (0.254 mm) and about 10 mils (2.54 mm) and most preferably a diameter in the range of between about 3 mil (0.76 mm) to about 4 mils (about 0.102 mm). Such diameters tend to impart the highly desirable quality of low stiffness to the synthetic monofilaments, thus making them more similar in stiffness to that of natural bristles. Previously, brushes with small diameter bristles, such as those formed using polyamides, have suffered from the drawback of failing to pick up sufficient material, such as cosmetic materials for application to the skin or other surfaces. Brushes according to the present invention are sufficiently small in diameter to have the highly desirable feel and texture of brushes made with natural bristles while still retaining the ample pick-up and application properties of stiffer brushes. In addition, synthetic monofilaments according to the present invention can optionally be hollow and can also be the product of co-extrusion of the thermoplastic elastomers of the present invention together with other polymeric materials, thus yielding synthetic monofilaments with new and additional desirable properties.

The highly desirable properties of the synthetic monofilaments of the present invention are due, in part, to the use of a thermoplastic elastomer and an aluminum silicate to form the extruded monofilaments, and to the post-conditioning and crimping processes. For example, the resulting synthetic monofilaments have a stiffness and flexural modulus on the average about 67% lower than that characteristic of filaments produced using standard 6,12 nylon (or polyamides) with comparable filament diameters and sizes (as shown by Tables 1 and 2, and FIG. 4). Such reduced stiffness is typical of natural bristles employed for the same uses as the synthetic monofilaments of the present invention.

The stiffness properties of various synthetic filaments are given in Table 1, along with diameter, flexural modulus and moment of inertia. Stiffness is determined in accordance with the following equation.

$$\begin{aligned}\text{Stiffness} &= \text{Flexural Modulus} \times \text{Moment of Inertia}\\ &= E \cdot I\end{aligned}$$

TABLE 1

Stiffness Properties of Various Synthetic Filaments

| | FLEX MODULUS (E) | | DIAMETER | | MOMENT OF INERTIA (I) | | STIFFNESS (EI) | |
|---|---|---|---|---|---|---|---|---|
| | KSI | GPA | IN | mm | IN^4 | mm^4 | LB*IN^2 | N*mm^2 |
| 6, 12 NYLON | 570 | 3.93 | 0.003 | 0.076 | 3.98E-12 | 1.65E-06 | 2.27E-06 | 6.50E-03 |
| 6, 12 NYLON | 570 | 3.93 | 0.002 | 0.051 | 7.85E-13 | 3.27E-07 | 4.48E-07 | 1.28E-03 |
| 6, 6 NYLON | 650 | 4.48 | 0.003 | 0.076 | 3.98E-12 | 1.65E-06 | 2.58E-06 | 7.42E-03 |
| PBT POLYESTER | 600 | 4.14 | 0.003 | 0.076 | 3.98E-12 | 1.65E-06 | 2.39E-06 | 6.85E-03 |
| TPE, HYTREL 7246 | 190 | 1.31 | 0.003 | 0.076 | 3.98E-12 | 1.65E-06 | 7.55E-07 | 2.17E-03 |

TABLE 2

RESULTS OF BRUSH SOFTNESS TEST

| Disp. in (mm) | | Force g (lbf) Goat Hair | | NBR E89677-23A | | Tynex | |
|---|---|---|---|---|---|---|---|
| 0 | 0 | 0 | 0 | 0 | 0 | 0 | 0.000 |
| 0.015 | (0.368) | 5.8 | (0.013) | 2.0 | (0.0045) | 6.2 | (0.014) |
| 0.030 | (0.735) | 8.2 | (0.018) | 3.0 | (0.0066) | 9.6 | (0.021) |
| 0.045 | (1.103) | 9.2 | (0.020) | 4.0 | (0.0088) | 11.0 | (0.024) |
| 0.060 | (1.470) | 10.2 | (0.022) | 4.6 | (0.0101) | 11.4 | (0.025) |
| 0.075 | (1.838) | 10.4 | (0.023) | 4.6 | (0.0101) | 12.0 | (0.026) |
| 0.090 | (2.205) | 10.6 | (0.023) | 4.8 | (0.0106) | 11.6 | (0.026) |
| 0.105 | (2.573) | 11.0 | (0.024) | 5.4 | (0.0119) | 12.4 | (0.027) |
| 0.125 | (3.063) | 11.6 | (0.026) | 5.4 | (0.0119) | 12.2 | (0.027) |
| 0.145 | (3.553) | 12.0 | (0.026) | 5.4 | (0.0119) | 12.4 | (0.027) |
| 0.170 | (4.165) | 12.6 | (0.028) | 5.6 | (0.0123) | 12.4 | (0.027) |
| 0.200 | (4.900) | 13.4 | (0.030) | 6.4 | (0.0141) | 13.8 | (0.030) |
| 0.250 | (6.125) | 14.2 | (0.031) | 7.2 | (0.0159) | 15.4 | (0.034) |
| 0.300 | (7.350) | 15.8 | (0.035) | 8.2 | (0.0181) | 19.4 | (0.043) |

Although goat hair is a common source of bristles for cosmetic and other types of brushes, flexural modulus and stiffness numbers were not available for such hair and so brush tests were performed to measure softness of an actual brush. Brushes made with 3 mil (0.76 mm) diameter 6,12 nylon, goat hair, and synthetic bristles of the present invention produced with the crimp gears were tested by the following procedure. The brushes were supported and traversed across a load cell in a way to simulate brushes being used to apply make-up to the cheek. The load cell was indexed to produce force readings at different levels of filament deflection. The results are plotted in the chart of FIG. 4.

Figure 4:
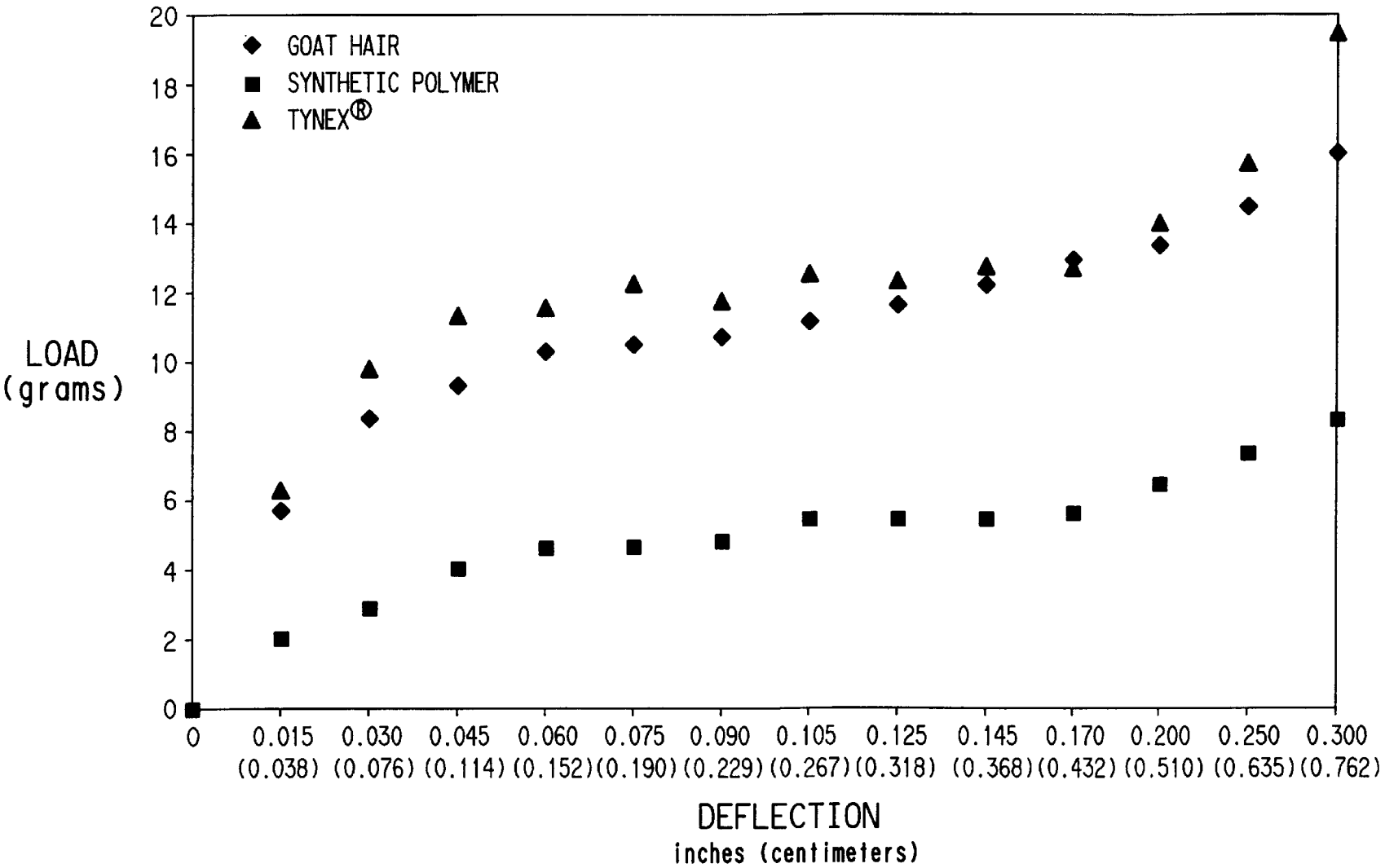
FIG. 4 graphically depicts the results of a stiffness determination of several synthetic bristles relative to a natural bristle (goat hair) and a common synthetic bristle (TYNEX® nylon filament available from E.I. du Pont de Nemours & Company).

With reference to FIG. 4, a graph is shown which plots load (weight in grams) along the vertical axis and the observed deflection (in inches or centimeters) along the horizontal axis. The data for goat hair is plotted using diamonds (♦); TYNEX® nylon filament supplied by E.I. du Pont de Nemours & Company, plotted as triangles (▲); and a synthetic polymer according to the present invention, plotted as squares (■). The values for this 2-dimensional graph are given in Table 2.

The results show clearly that the filament of the invention is much softer than the 6,12 nylon (TYNEX®) and also softer than the goat hair, since for the bristles of the invention each displacement or deflection (in inches or centimeters) requires a correspondingly smaller load (weight in grams) relative to the natural and synthetic bristles. The actual force (weight in grams) and displacement or deflection (inches) numbers are given in Table 2 so that FIG. 4 represents a 2-dimensional plot of the values of Table 2.

Addition of the aluminum silicate, usually in hydrated form, has the effect of dulling the colorant and also producing a matte finish. The presence of the aluminum silicate in the composition used to produce the synthetic monofilaments of the present invention also produces a very unique feel and texture in the finished product by reducing the slickness of the surface. As such, the matte appearance imparted to the colored monofilaments also helps to emulate the appearance of natural bristles.

An additional advantage of using the synthetic monofilaments of the present invention is their unexpected strength, thus showing little or no breakage of the monofilaments after repeated usage.

The synthetic monofilaments according to the present invention differ from those currently sold on the market as natural bristle replacements in that the bristles of the present invention employ a different polymer composition to produce the lower stiffness and flexural modulus that simulate the natural bristles, whereas the current commercially available replacements simulate the natural bristles by using smaller filaments of nylon and polyesters. The use of TPE to form the synthetic monofilaments of the present invention thereby achieves a stiffness equivalent to or less than that of the natural bristles, such as goat hair bristles, of the same filament diameter. The TPE filaments will therefore handle and undergo processing in much the same way as the natural bristles. In addition, the appearance of the crimp is different from previously produced bristles. The crimp produced by traditional gears and even non-traditional gears, such as the crimp produced in U.S. Pat. No. 5,195,546, look mechanical and artificial in the final brush. The crimp produced according to the present invention is much more subtle and very similar to the wave of natural filaments used in brushes.

Natural filaments tend to vary in size and differ in diameter and thus a natural bristle brush will contain bristles of varying sizes. The bristles made according to the present invention can be prepared in mixed-diameter form so as to better simulate natural filaments than a product containing filaments of all the same diameter. This is conveniently accomplished by extruding the molten polymer through a spinnerette plate with various diameter capillaries and thereby producing a filament rope consisting of individual filaments with diameters in the range of 1–10 mils (about 0.254 mm to about 2.54 mm), especially in the range of 2–5 mils (or about 0.5 mm to about 1.27 mm). The filaments are then processed in the same way as already described and a brush with such different sized synthetic filaments is easily produced.

Production of the synthetic monofilaments according to the present invention succeeds in ensuring a steady supply of high quality and uniform material. The filaments of the present invention, formed from TPE and aluminum silicate, also eliminate the need for hygienic and antiseptic treatment and eliminate the opportunity for undesirable residues left behind by such treatments. In addition, the use of TPE to form such monofilaments is highly desirable as a means of eliminating the unfortunate allergic reactions sometimes experienced by persons sensitive to natural bristles.

The synthetic monofilaments according to the present invention can be formed in a variety of different ways and in any desired lengths for sale and resale of the finished products. The synthetic monofilaments according to the present invention can be produced in long stretches of monofilaments, in spools, and otherwise. Thus, for example, one continuous length of the synthetic monofilaments or bristles can be produced and then cut into 45 inch (about 115 cm) long hanks, which can then be cut further by end or near-end by users such as brush makers.

The present invention is also directed to a brush, especially one for applying cosmetic products to the human skin, composed of a plurality of the synthetic monofilaments made according to the methods recited herein, and of a composition recited herein, and having a handle for holding or retaining the synthetic monofilaments. Such a brush would commonly contain bristles extending outward for at least about ⅛ inch (3.175 mm) from at least one end of the handle but the bristles could easily be extended to almost any length or distance from the handle of the brush, the desired distance being predominantly a function of the use to which the brush will be put. Brushes according to the present invention may also contain a mixture of the bristles of the present invention mixed with bristles of a different type, although the bristles according to the present invention will typically make up the majority of the plurality of bristles used to form such a brush. Brushes made using the synthetic monofilaments according to the present invention will also find uses in addition to applying cosmetics and other products to the human skin. Such other uses may include, but are not limited to, use as brushes for applying substances to the surfaces of various foods, and in the food industry generally, as well as utility in the production and manufacture of artists' brushes and wherever the intended utility requires a brush having bristles of low stiffness.

Other uses and advantages of the present invention will undoubtedly suggest themselves after reviewing the foregoing teachings and description of the present invention. All descriptions of the manufacture and uses of specific embodiments of the bristles and compositions disclosed herein, and brushes made using such embodiments, are intended as a guide and are in no way intended as limiting any embodiments of the invention or their uses.

What is claimed is:

1. A synthetic monofilament formed from a composition comprising a thermoplastic elastomer and an aluminum silicate, wherein said synthetic monofilament has a flex modulus of 190 ksi.

2. The synthetic monofilament of claim 1 further comprising a colorant.

3. The synthetic monofilament of claim 1 wherein the synthetic monofilament has a stiffness equal to or less than that of a goat hair bristle having a diameter equal to the synthetic monofilament.

4. The synthetic monofilament of claim 1 wherein the thermoplastic elastomer is present in a proportion in the range of between about 80% and about 98% by weight.

5. The synthetic monofilament of claim 1 wherein the thermoplastic elastomer is present in a proportion in the range of between about 85% to about 93% by weight.

6. The synthetic monofilament of claim 1 wherein the thermoplastic elastomer is present in a proportion of about 87% by weight.

7. The synthetic monofilament of claim 1 wherein the aluminum silicate is present in a proportion in the range of between about 2% to about 5% by weight.

8. The synthetic monofilament of claim 1 wherein the aluminum silicate is present in a proportion of about 3% by weight.

* * * * *